US010283852B2

(12) United States Patent
Thiam et al.

(10) Patent No.: US 10,283,852 B2
(45) Date of Patent: May 7, 2019

(54) VEHICULAR ANTENNA ASSEMBLY INCLUDING A REFLECTOR INTERNALLY MOUNTED WITHIN A RADOME

(71) Applicant: Laird Technologies, Inc., Earth City, MO (US)

(72) Inventors: Cheikh T. Thiam, Grand Blanc, MI (US); Curtis Wendell Beaulieu, Fenton, MO (US); Thomas William Howay, Metamora, MI (US); Ayman Duzdar, Holly, MI (US); Hasan Yasin, Grand Blanc, MI (US)

( * ) Notice: Subject to any disclaimer, the term of this patent is extended or adjusted under 35 U.S.C. 154(b) by 231 days.

(21) Appl. No.: 15/468,634

(22) Filed: Mar. 24, 2017

(65) Prior Publication Data

US 2018/0083348 A1 Mar. 22, 2018

Related U.S. Application Data

(60) Provisional application No. 62/395,599, filed on Sep. 16, 2016.

(51) Int. Cl.

| | |
|---|---|
| ***H01Q 1/12*** | (2006.01) |
| ***H01Q 1/32*** | (2006.01) |
| ***H01Q 1/38*** | (2006.01) |
| ***H01Q 1/42*** | (2006.01) |
| ***H01Q 9/04*** | (2006.01) |
| ***H01Q 9/42*** | (2006.01) |
| ***H01Q 15/14*** | (2006.01) |
| ***H01Q 19/10*** | (2006.01) |
| ***H01Q 21/24*** | (2006.01) |
| ***H01Q 21/28*** | (2006.01) |
| ***H01Q 5/371*** | (2015.01) |

(52) U.S. Cl.

CPC ..... *H01Q 1/3275* (2013.01); *H01Q 1/1214* (2013.01); *H01Q 1/38* (2013.01); *H01Q 1/42* (2013.01); *H01Q 5/371* (2015.01); *H01Q 9/0407* (2013.01); *H01Q 9/42* (2013.01); *H01Q 15/14* (2013.01); *H01Q 19/104* (2013.01); *H01Q 21/24* (2013.01); *H01Q 21/28* (2013.01)

(58) Field of Classification Search

CPC ..... H01Q 1/3275; H01Q 1/42; H01Q 9/0407; H01Q 15/14; H01Q 19/104

See application file for complete search history.

(56) References Cited

U.S. PATENT DOCUMENTS

| | | | | |
|---|---|---|---|---|
| 6,184,840 | B1 * | 2/2001 | Hsin-Loug | H01Q 1/42 343/781 CA |
| 7,492,318 | B2 | 2/2009 | Duzdar et al. | |
| 7,492,319 | B2 | 2/2009 | Lindackers et al. | |
| 2008/0100521 | A1 | 5/2008 | Herbert et al. | |
| 2014/0292593 | A1 | 10/2014 | Thiam et al. | |

* cited by examiner

*Primary Examiner* — Robert Karacsony

(74) *Attorney, Agent, or Firm* — Harness, Dickey & Pierce, P.L.C.; Anthony G. Fussner

(57) ABSTRACT

According to various aspects, exemplary embodiments are disclosed herein of vehicular antenna assemblies and radome assemblies for vehicular antenna assemblies. In exemplary embodiments, a radome includes a mount along an inner surface of the radome. A reflector is mounted to the mount of the radome. The mount and the reflector are configured such that the reflector is operable for reflecting, refocusing, and/or directing satellite signals generally towards a satellite antenna of the vehicular antenna assembly when the radome is positioned over the satellite antenna.

17 Claims, 16 Drawing Sheets

VEHICULAR ANTENNA ASSEMBLY INCLUDING A REFLECTOR INTERNALLY MOUNTED WITHIN A RADOME

CROSS-REFERENCE TO RELATED APPLICATION

This patent application claims the benefit of and priority to U.S. Provisional Patent Application No. 62/395,599 filed Sep. 16, 2016. The entire disclosure of the above application is incorporated herein by reference.

FIELD

The present disclosure generally relates to a vehicular antenna assembly that includes a reflector internally mounted within a radome.

BACKGROUND

This section provides background information related to the present disclosure which is not necessarily prior art.

Various different types of antennas are used in the automotive industry, including AM/FM radio antennas, Satellite Digital Audio Radio Service (SDARS) antennas (e.g., SiriusXM satellite radio, etc.), Global Navigation Satellite System (GNSS) antennas, cellular antennas, etc. Multiband antenna assemblies are also commonly used in the automotive industry. A multiband antenna assembly typically includes multiple antennas to cover and operate at multiple frequency ranges.

Automotive antennas may be installed or mounted on a vehicle surface, such as the roof, trunk, or hood of the vehicle to help ensure that the antennas have unobstructed views overhead or toward the zenith. The antenna may be connected (e.g., via a coaxial cable, etc.) to one or more electronic devices (e.g., a radio receiver, a touchscreen display, navigation device, cellular phone, etc.) inside the passenger compartment of the vehicle, such that the multiband antenna assembly is operable for transmitting and/or receiving signals to/from the electronic device(s) inside the vehicle.

DRAWINGS

The drawings described herein are for illustrative purposes only of selected embodiments and not all possible implementations, and are not intended to limit the scope of the present disclosure.

Figure 3:
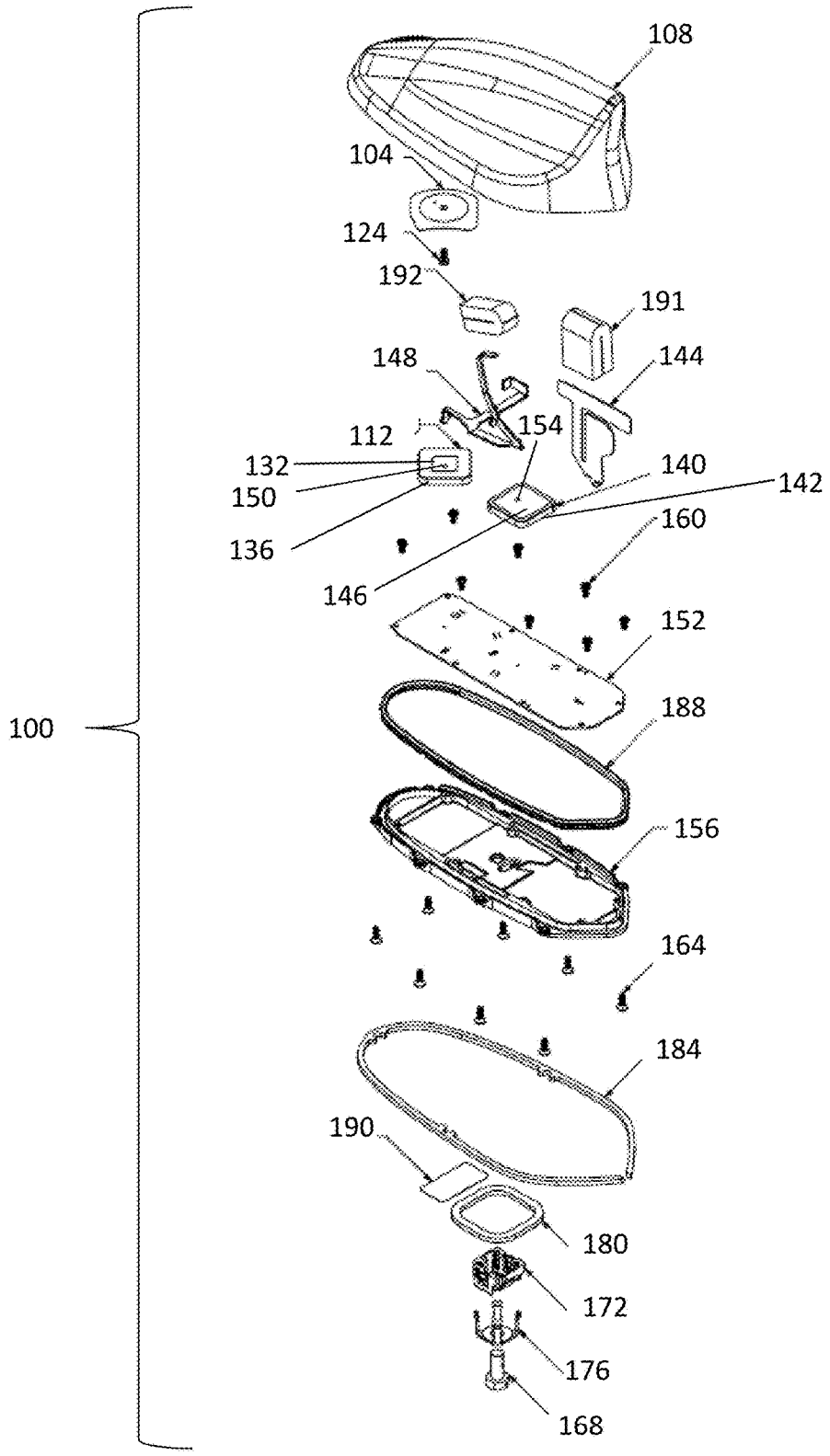
FIG. 3 is an exploded perspective view of an exemplary embodiment of a vehicular antenna assembly that includes the reflector internally mountable within a radome above a patch antenna as shown in FIGS. 1 and 2.
Figure 5:
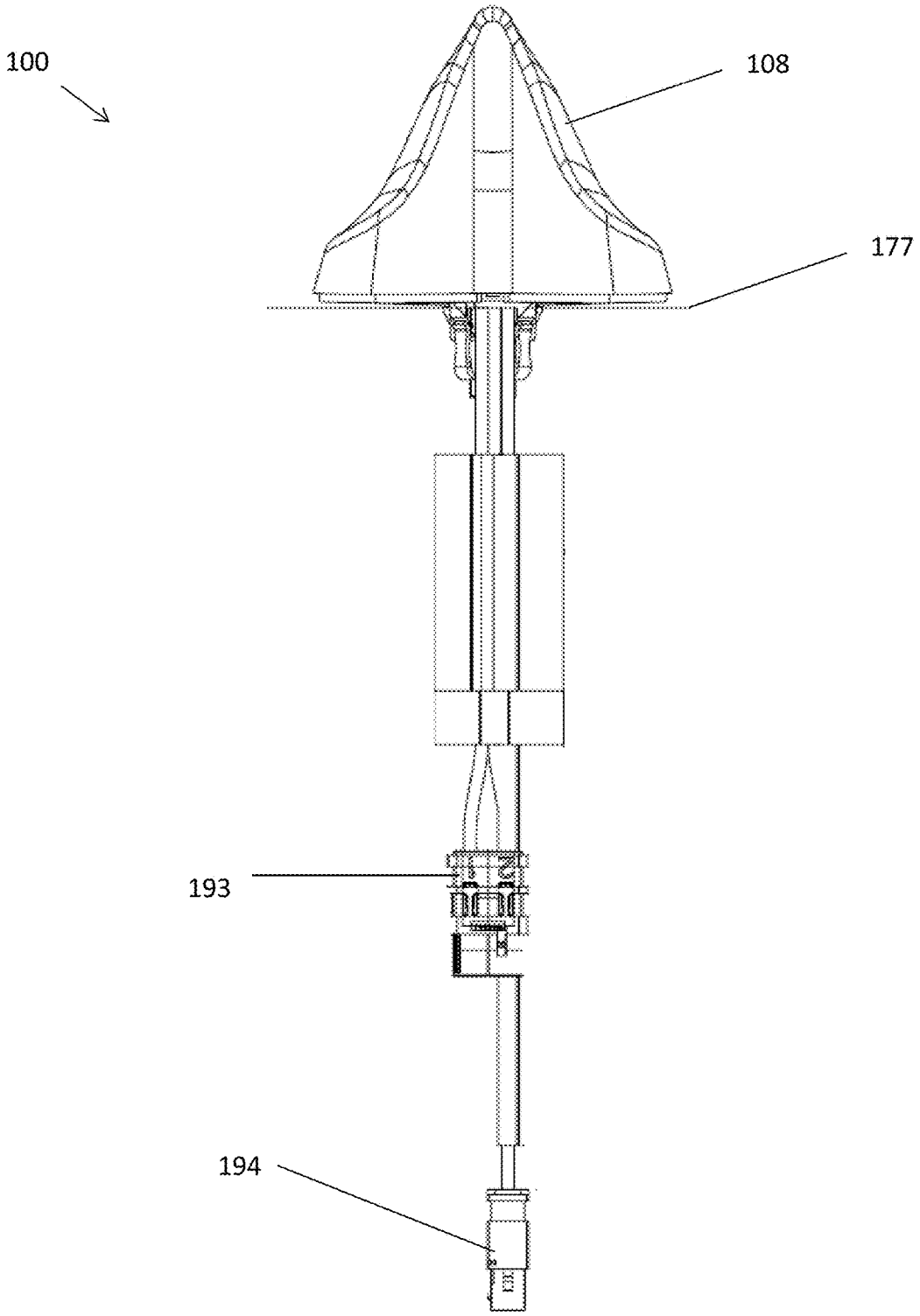
Figure 6:
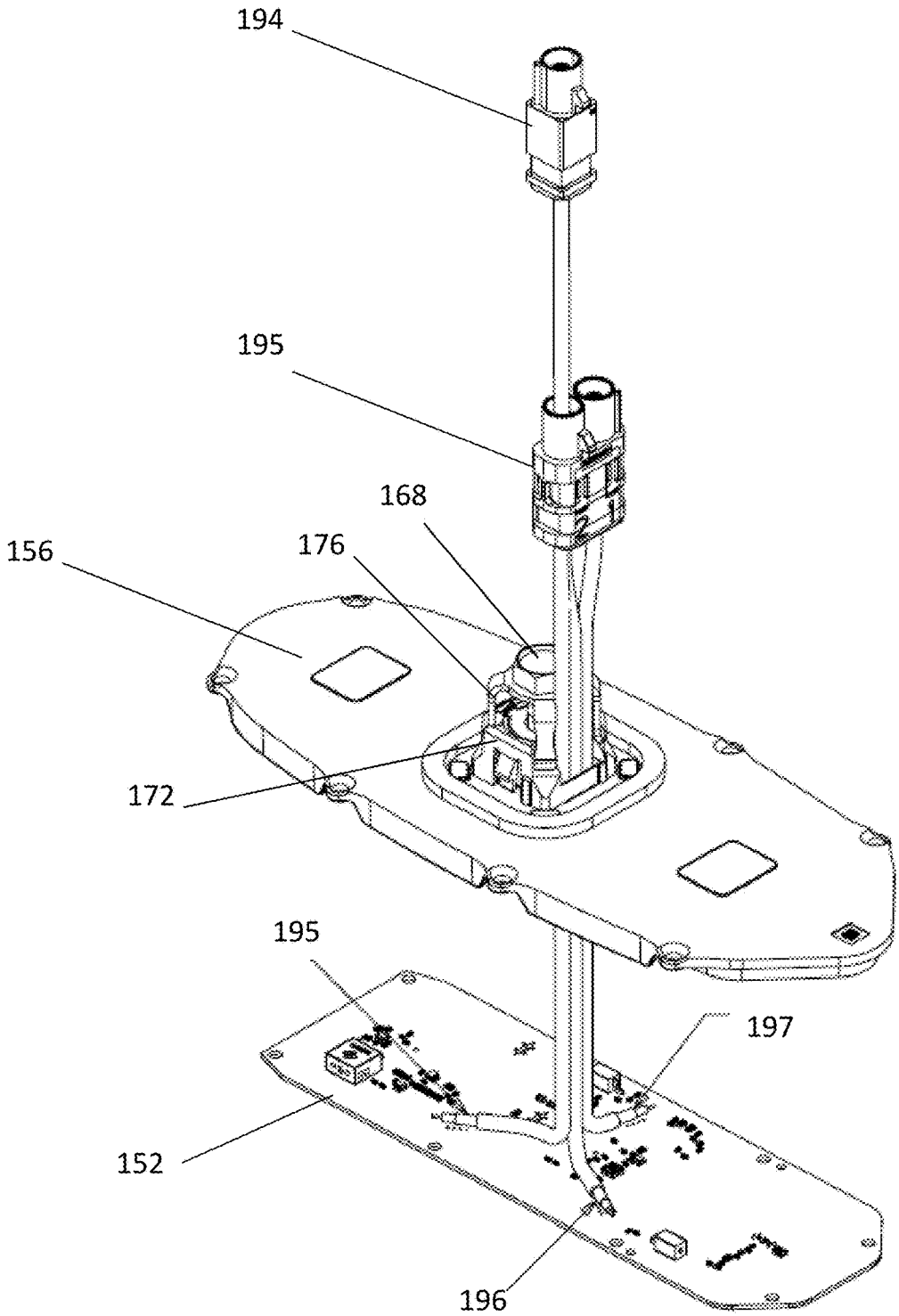
Figure 7:
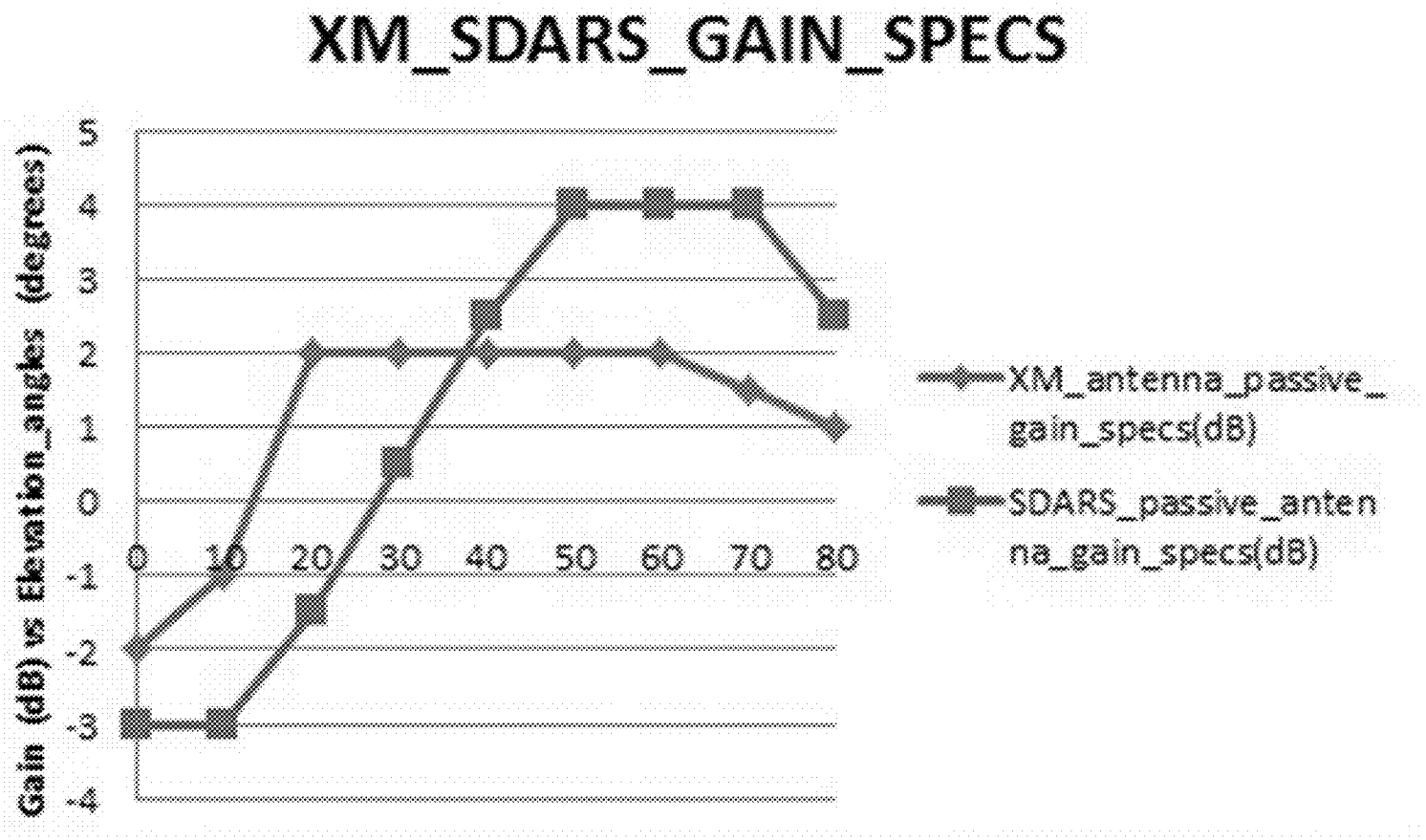
Figure 8:
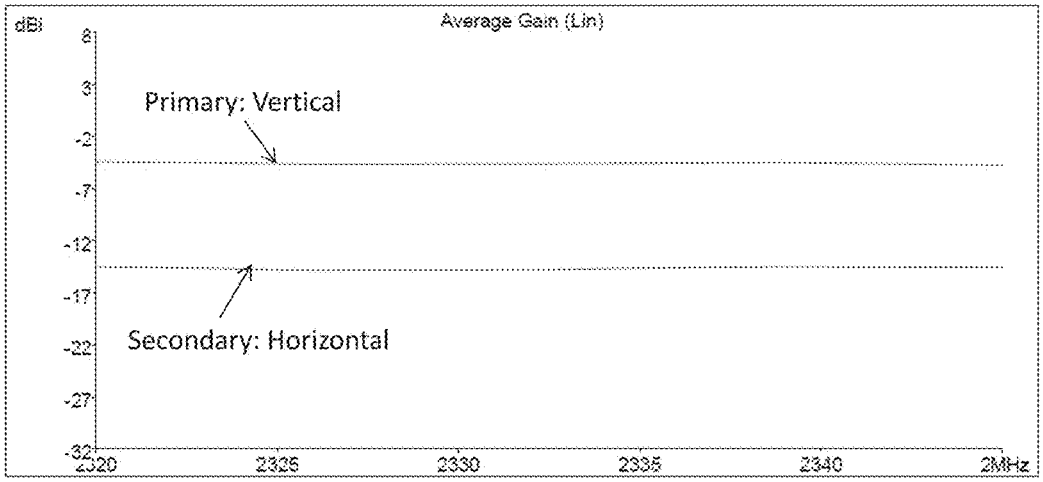
Figure 9:
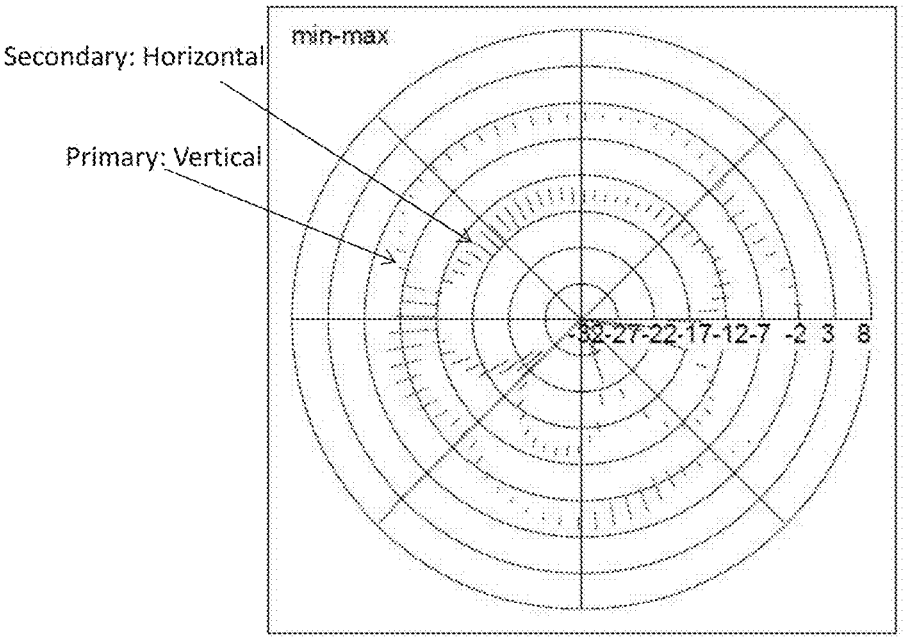
Figure 10:
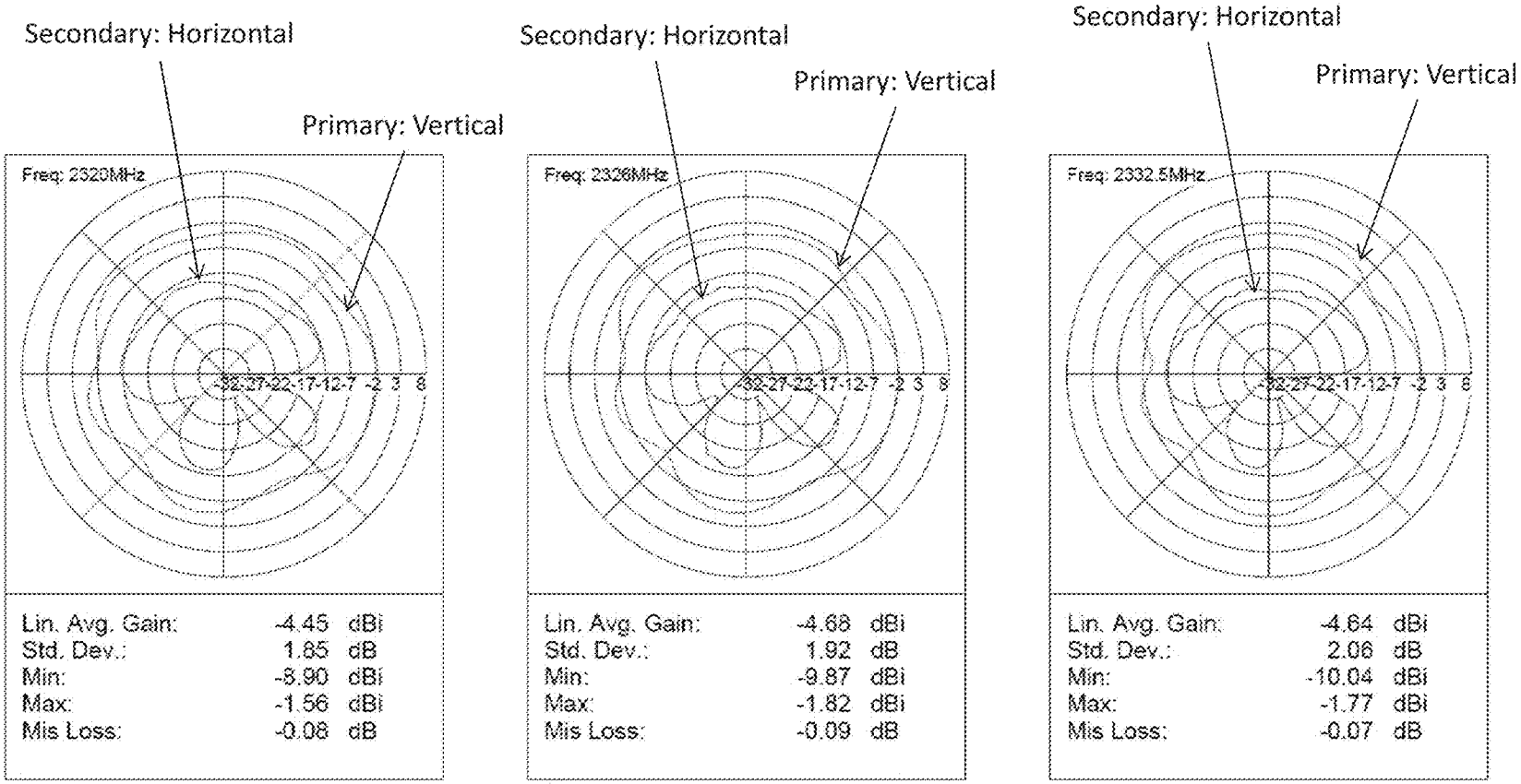
Figure 11:
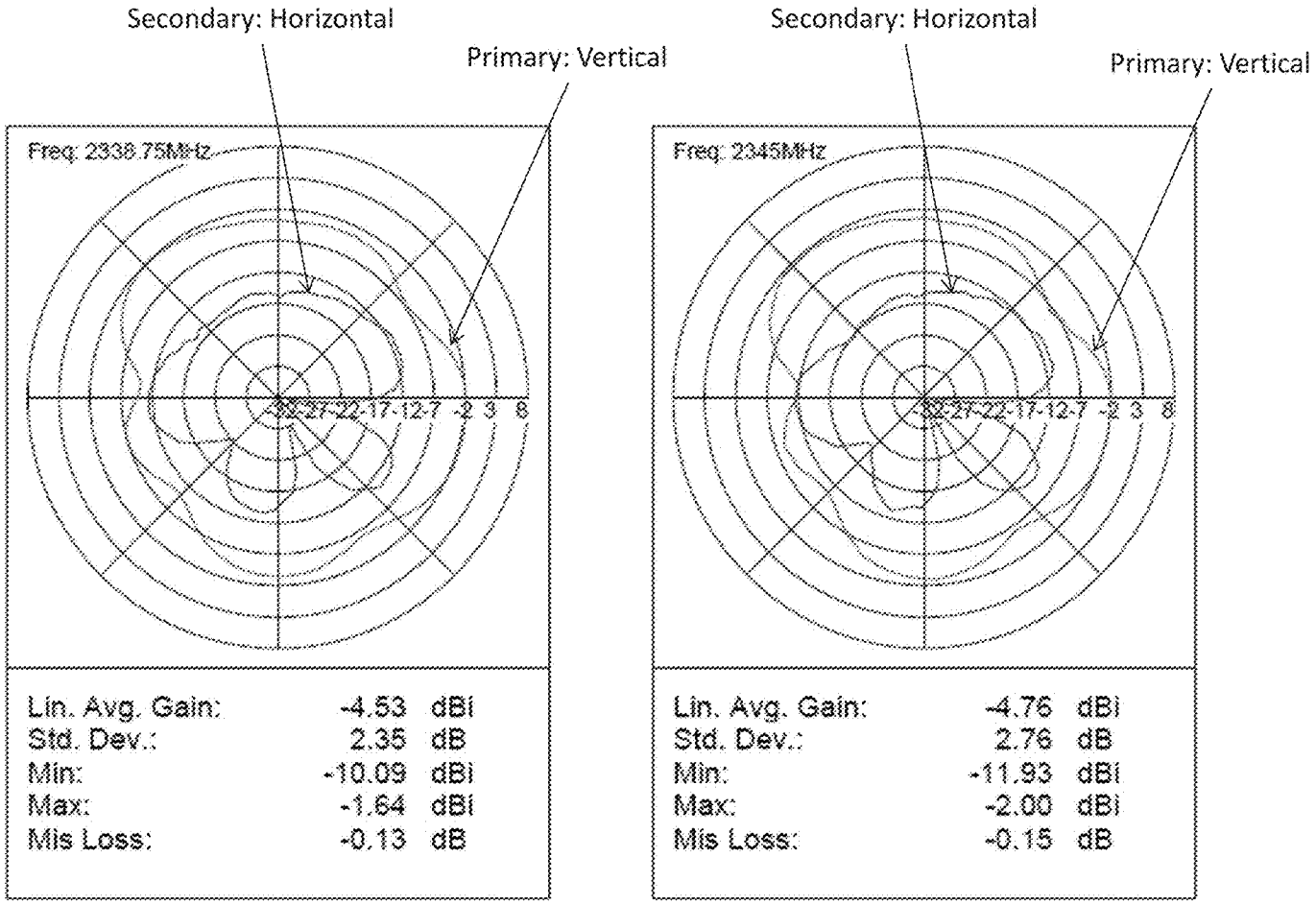
Figure 12:
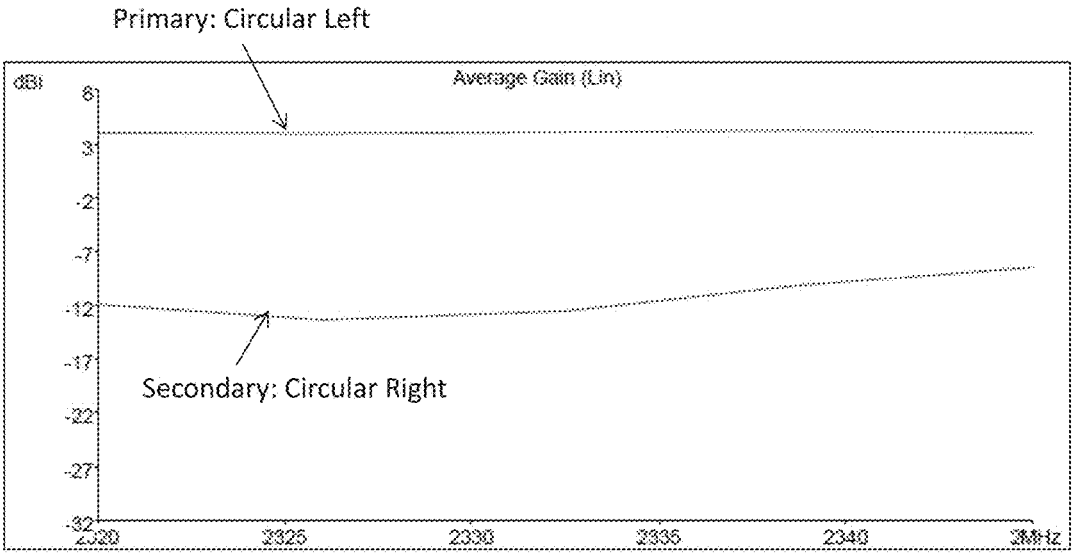
Figure 13:
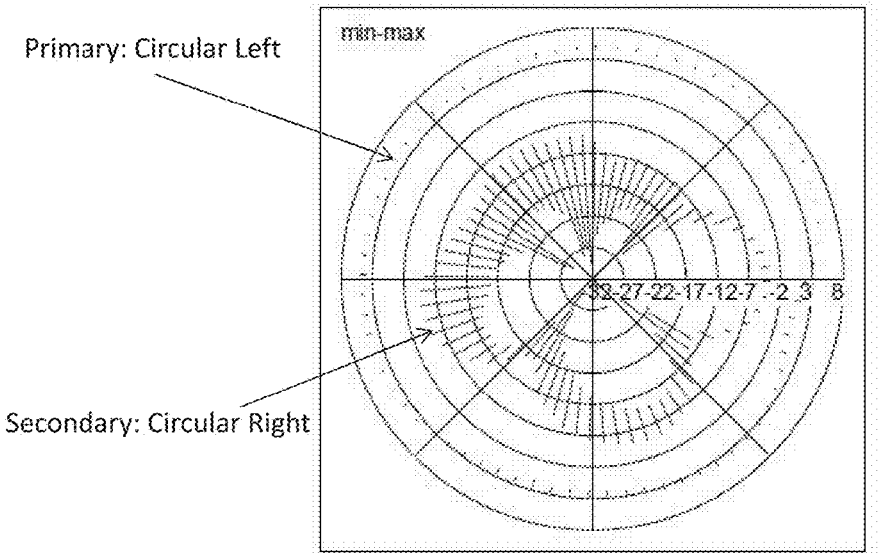
Figure 14:
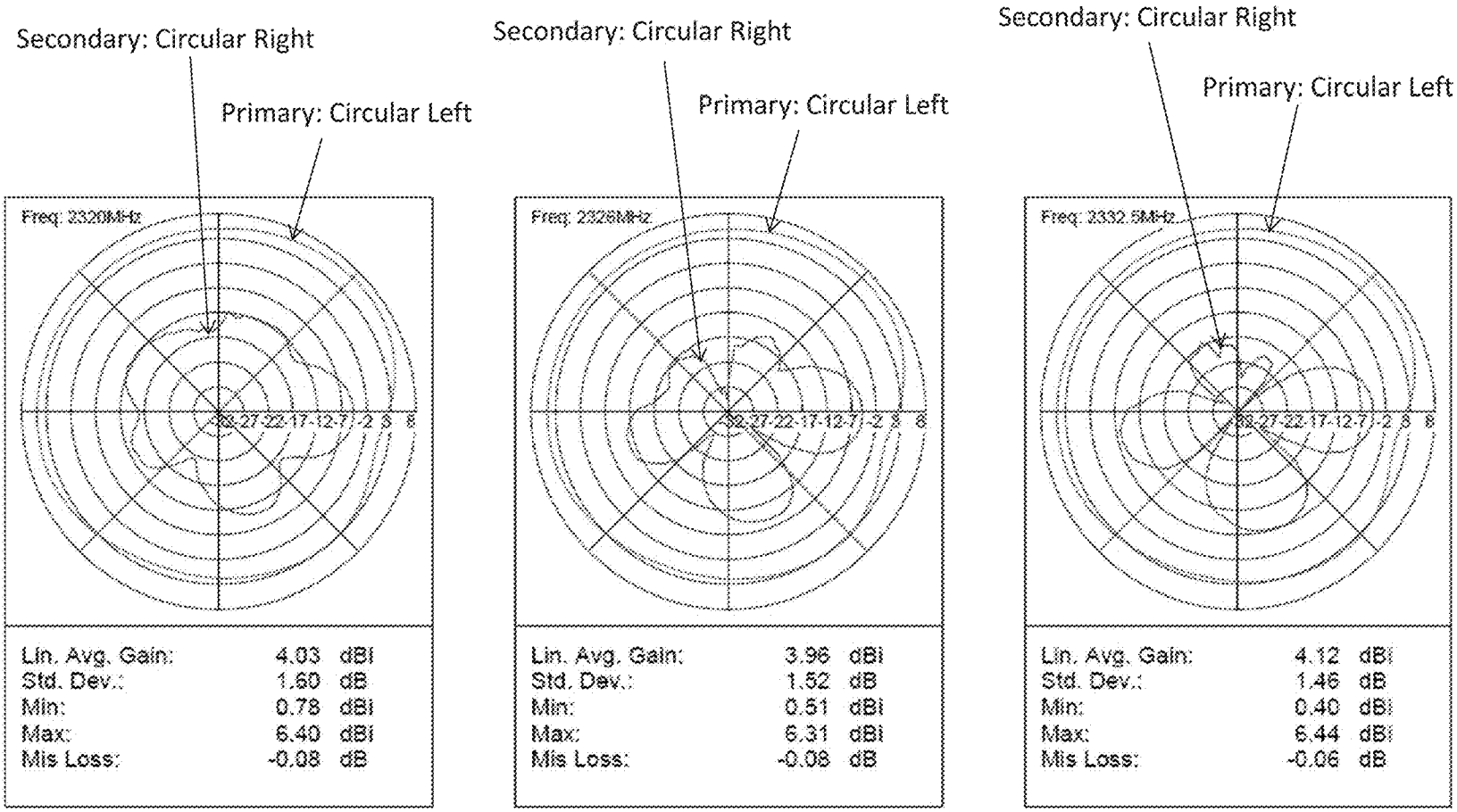
Figure 15:
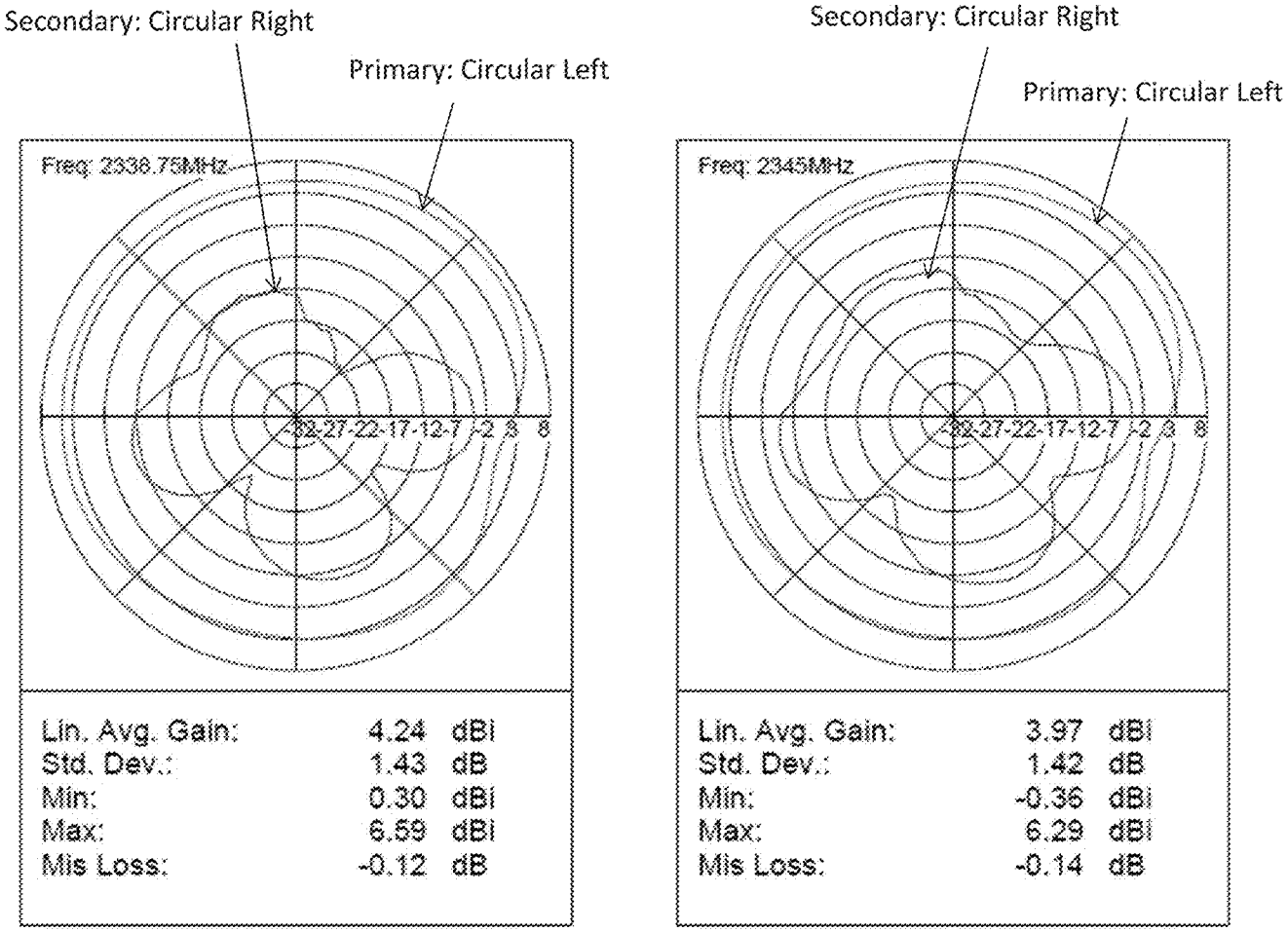
Figure 16:
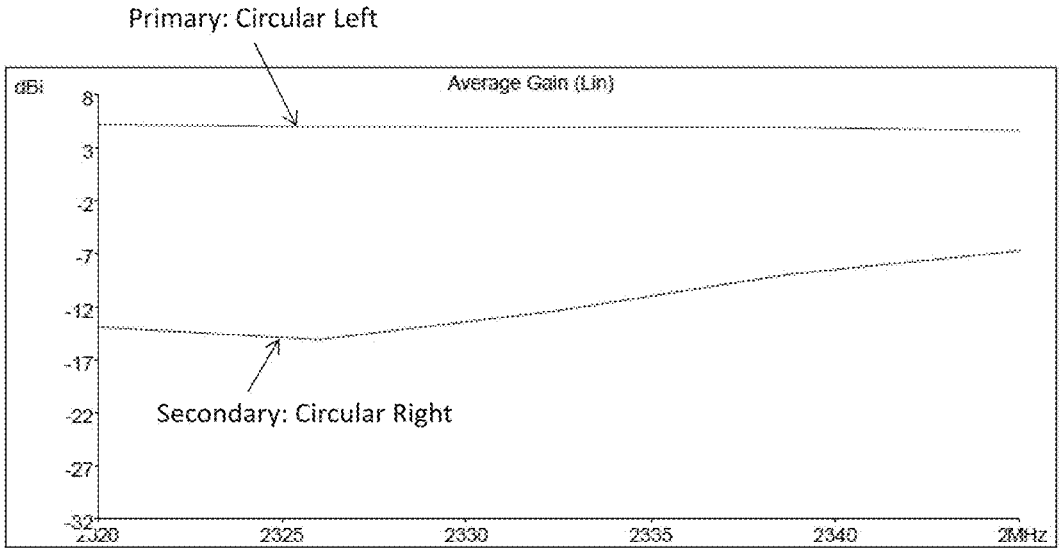
Figure 17:
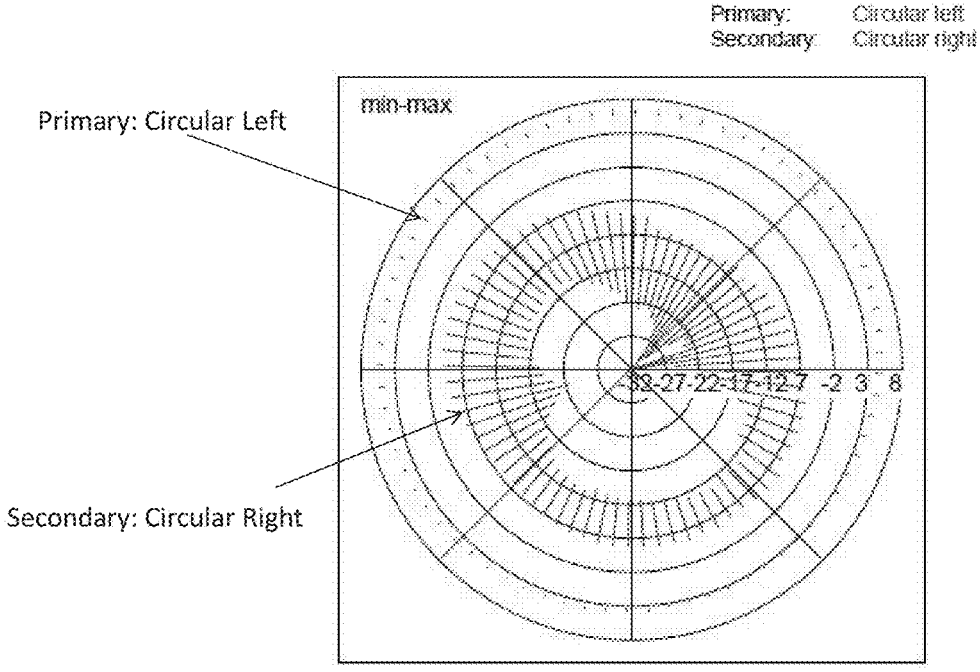
Figure 18:
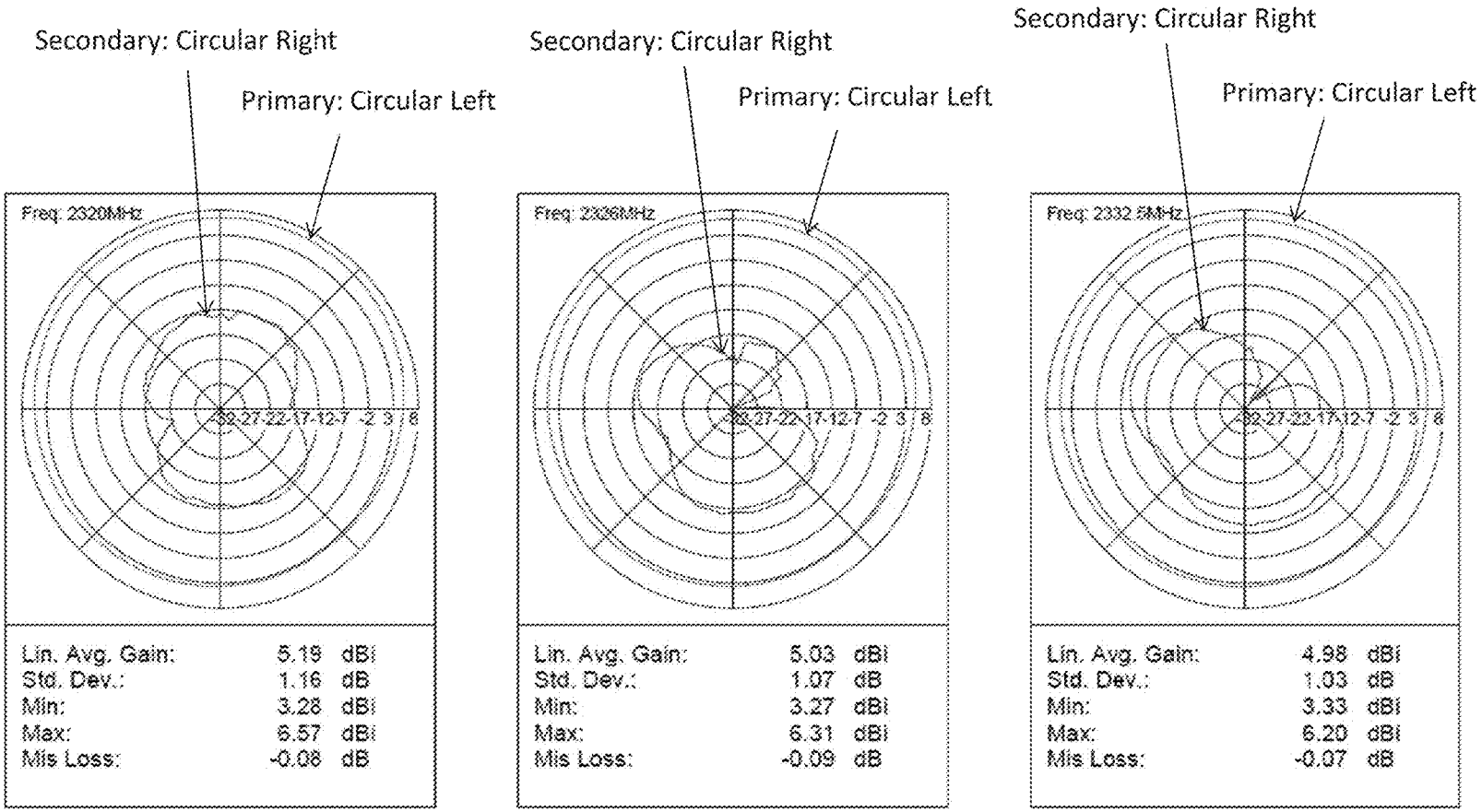
Figure 19:
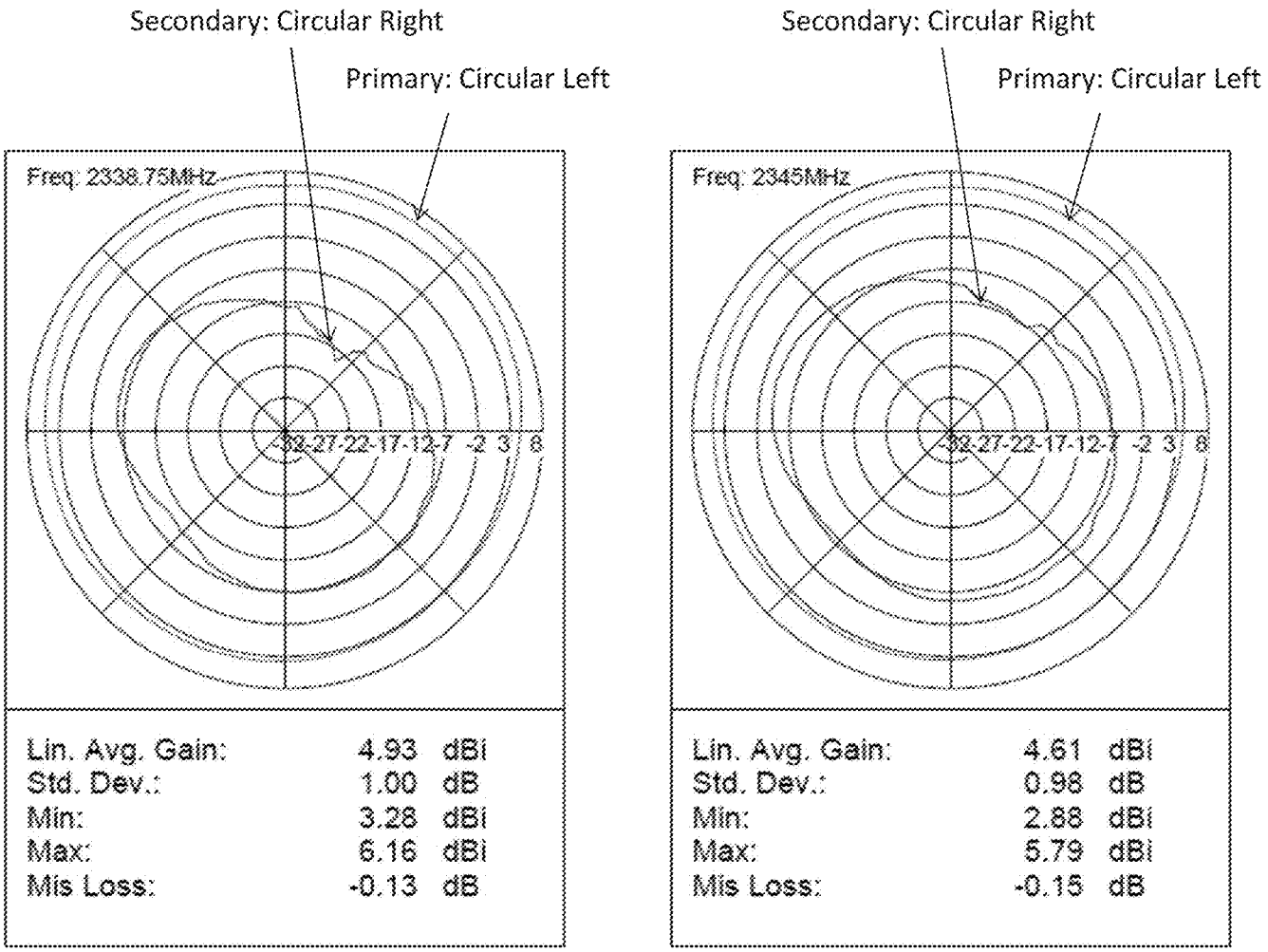

FIG. 5 is a front view of the vehicular antenna assembly shown in FIG. 3 after the components have been assembled, and also illustrating coaxial cable assemblies for connecting the vehicular antenna assembly to one or more electronic devices inside the passenger compartment of a vehicle, such that the vehicular antenna assembly is operable for transmitting and/or receiving signals to/from the electronic device(s) inside the vehicle;

FIG. 6 is a perspective view showing an exemplary manner by which the coaxial cables shown in FIG. 5 may be connected to components along a bottom side of the printed circuit board of the vehicular antenna assembly shown in FIG. 3;

FIG. 7 is a line graphs showing XM and SDARS passive antenna gain specifications in decibels (dB) versus elevation angle in degrees;

FIG. 8 is a line graph of linear average gain (rotating linear polarization) in decibels-isotropic (dBi) versus SDARS frequencies from 2320 megahertz (MHz) to 2345 MHz for the patch antenna below the reflector of the multiband antenna assembly shown in FIGS. 1 through 3 on a one-meter diameter rolled edge ground plane, zero degree module and vertical polarization;

FIGS. 9 through 11 illustrate radiation patterns at various SDARS frequencies for the patch antenna below the reflector of the multiband antenna assembly shown in FIGS. 1 through 3 on a one-meter diameter rolled edge ground plane, zero degree module, and vertical polarization;

FIG. 12 is a line graph of linear average gain (rotating linear polarization) in decibels-isotropic (dBi) versus SDARS frequencies from 2320 megahertz (MHz) to 2345 MHz for the patch antenna below the reflector of the multiband antenna assembly shown in FIGS. 1 through 3 on a one-meter diameter rolled edge ground plane, fifty degree module and left circular polarization;

FIGS. 13 through 15 illustrate radiation patterns at various SDARS frequencies for the patch antenna below the reflector of the multiband antenna assembly shown in FIGS. 1 through 3 on a one-meter diameter rolled edge ground plane, fifty degree module, and left circular polarization;

FIG. 16 is a line graph of linear average gain (rotating linear polarization) in decibels-isotropic (dBi) versus SDARS frequencies from 2320 megahertz (MHz) to 2345 MHz for the patch antenna below the reflector of the multiband antenna assembly shown in FIGS. 1 through 3 on a one-meter diameter rolled edge ground plane, seventy degree module and left circular polarization; and FIGS. 17 through 19 illustrate radiation patterns at various SDARS frequencies for the patch antenna below the reflector of the multiband antenna assembly shown in FIGS. 1 through 3 on a one-meter diameter rolled edge ground plane, seventy degree module, and left circular polarization.

Corresponding reference numerals indicate corresponding parts throughout the several views of the drawings.

DETAILED DESCRIPTION

Example embodiments will now be described more fully with reference to the accompanying drawings.

Exemplary embodiments are disclosed herein of vehicular antenna assemblies that include a reflector (e.g., an electrically-conductive plate, other electrically-conductive parasitic element, etc.) internally mounted within (e.g., mechanically fastened to, etc.) a radome above a satellite antenna (e.g., SDARS patch antenna, etc.). In exemplary embodiments, a vehicular antenna assembly includes a radome mounted reflector above a patch antenna. The reflector may be configured to operable for helping increase passive antenna gain at higher elevation angles. But in doing so, the reflector may also decrease passive antenna gain at lower elevation as the total energy radiated is the same, it is just being distributed differently in space. The reflector may thus allow the vehicular antenna assembly to meet or satisfy the interoperable 03 specifications for SiriusXM satellite radio including the passive antenna gain specifications shown in FIG. 7.

Advantageously, the radome mounted reflector provides a relatively convenient and cost effective way to meet the interoperable SiriusXM 03 specifications for SiriusXM Satellite Radio without requiring major structural modifications of the existing antenna assembly and without requiring alterations to other antenna functionality (e.g., cellular, GNSS, AM/FM, etc.). The reflector is used to reflect, refocus, and/or direct signals from the satellite(s) to meet the interoperable (SiriusXM) 03 specifications. In an exemplary embodiment, a single screw is used to attach a reflector (e.g., a circular electrically-conductive reflector plate, etc.) to a mounting structure of the radome. This exemplary embodiment thus allows the reflector to be attached to the radome using a single fastener in a relatively quick and simple assembly process.

Figure 1:
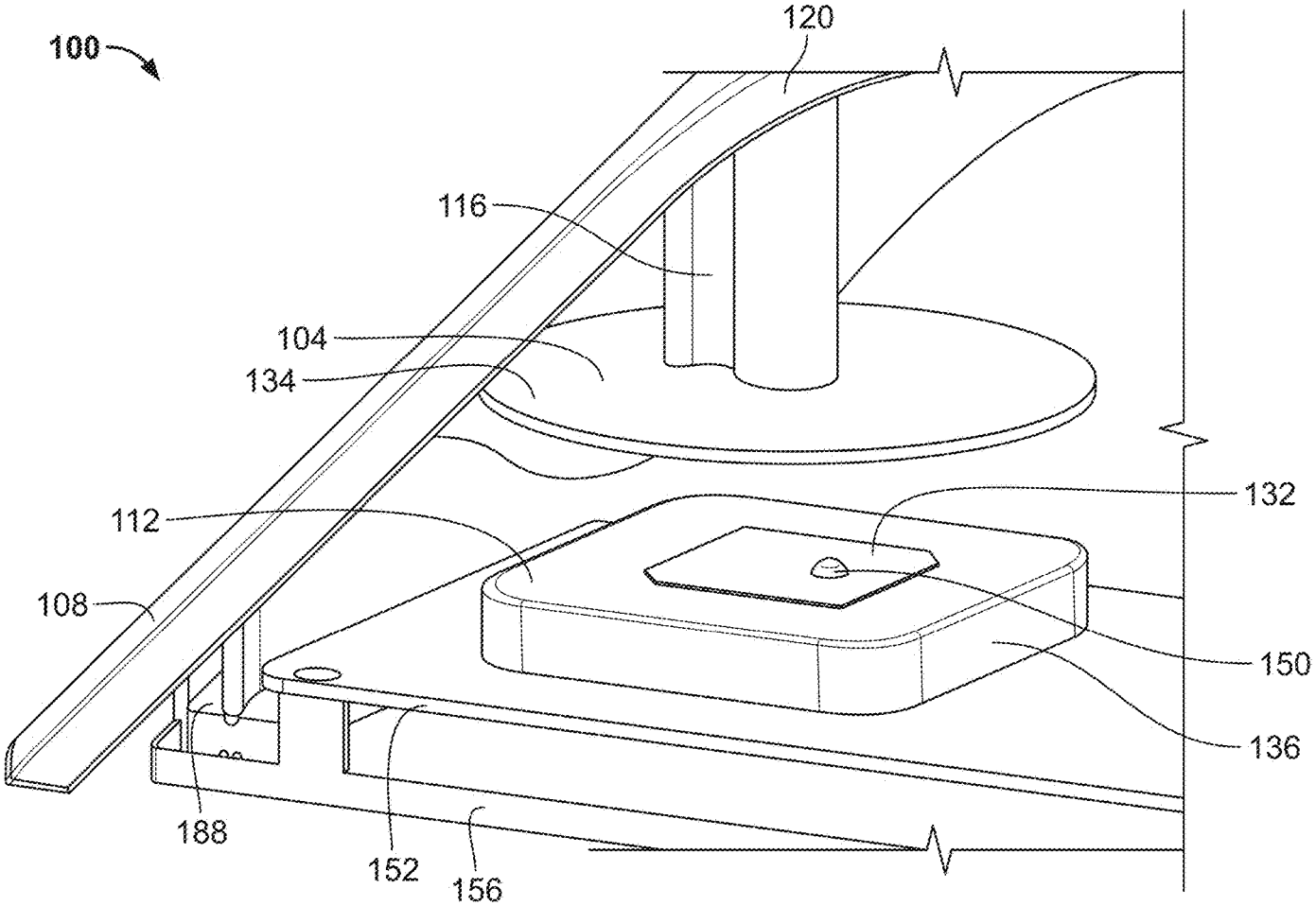
FIG. 1 is a perspective view of a portion of a vehicular antenna assembly including a reflector internally mounted within a radome above a patch antenna according to an exemplary embodiment.
Figure 2:
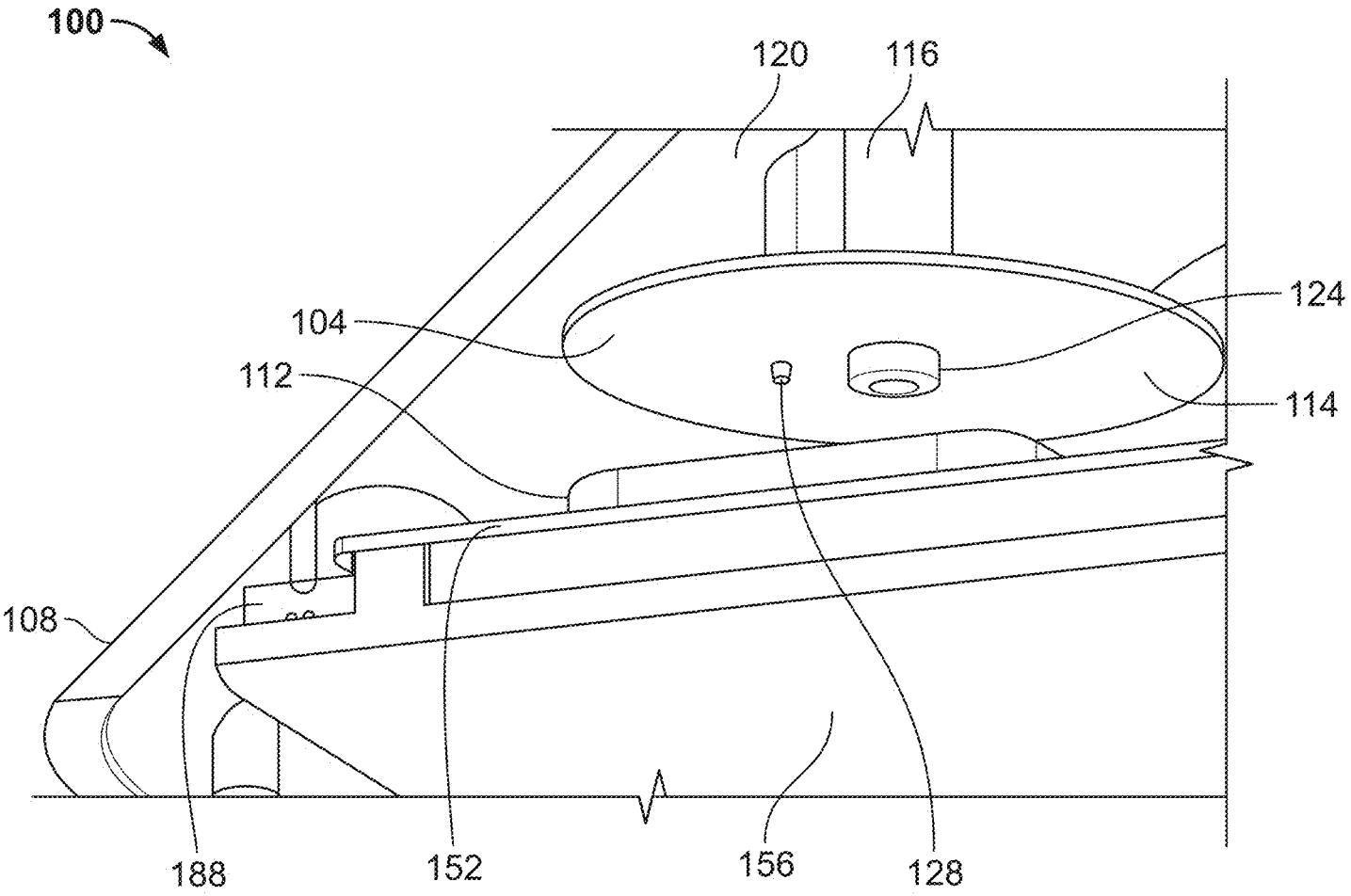
FIG. 2 is a lower perspective of the portion of the vehicular antenna assembly shown in FIG. 1, and illustrating a mechanical fastener being used to mount the reflector to a mount or support internal to the radome that extends downward from an inner or interior surface of the radome.

With reference now to the figures, FIGS. 1 and 2 illustrate a portion of a vehicular antenna assembly 100 embodying one or more aspects of the present disclosure. As shown in FIGS. 1 and 2, the antenna assembly 100 includes a reflector 104 internally mounted (e.g., mechanically fastened to, etc.) under or within a radome 108 above a satellite antenna 112 (e.g., SDARS patch antenna, etc.).

As disclosed herein, the reflector 104 is configured (e.g., sized, shaped, located, material, etc.) to be operable for reflecting, refocusing, and/or directing signals received from a satellite(s) generally towards the satellite antenna 112. The satellite antenna 112 may comprise a patch antenna configured to be operable for receiving SDARS signals (e.g., SiriusXM, etc.). The reflector 104 may comprise a substantially planar or flat electrically-conductive surface 114 that is substantially parallel with and spaced-apart from the antenna structure or radiating element 132 of the patch antenna 112.

In exemplary embodiments, the reflector 104 allows the antenna assembly 100 to satisfy or meet the interoperable 03 specifications for SiriusXM satellite radio including the passive antenna gain specifications shown in FIG. 7. The reflector 104 provides a convenient and cost effective way to meet the new 03 specs without major structural modifications to the antenna assembly 100 and without altering any other functionality (e.g., cellular, GNSS, AM/FM, etc.) of the antenna assembly 100.

As shown in FIG. 7, the XM passive antenna gain specifications require higher gain at lower elevations angles relative to the SDARS passive antenna gain. Conversely, the XM passive antenna gain specifications also require lower gain at higher elevation angles relative to the SDARS passive antenna gain. The reflector 104 helps increase the passive antenna gain at higher elevation angles. But in doing so, the reflector 104 also decreases the passive antenna gain at lower elevation angles as the total energy radiated is the same, it is just being distributed differently in space. For the X-axis (horizontal with elevation angles) in FIG. 7, it should be noted that zero degree along the X axis refers or points to horizon. Conventionally, zero degree is at boresight or Zenith. Accordingly, the angles along the X-axis of the line graph in FIG. 7 are complementary to 90 degrees relative to conventional wisdom.

As shown in FIGS. 1 and 2, the reflector 104 is coupled (e.g., mechanically fastened, etc.) to a mount or support 116 (e.g., an integral mounting means or feature, a mounting member, etc.) within, under, or internal to the radome 108. The mount or support 116 extends downwardly relative to an inner or interior surface 120 of the radome 108 towards the satellite antenna 112. The reflector and the mount or support 116 are above and spaced apart from the satellite antenna 112.

The mount 116 for the reflector 104 may comprise an integral portion of the radome 108. The mount 116 may be integrally formed (e.g. injection molded from polymer, etc.) with the radome 108 such that the radome 108 and mount 116 have a monolithic, single piece construction. Accordingly, the mount 116 is not a discrete element that must be separately attached to the radome 108. Alternatively, the mount 116 may comprise a separate or discrete element that is coupled or attached (e.g., adhesively attached, ultrasonically welded, mechanically fastened, etc.) to the inner surface 120 of the radome 108.

For the illustrated embodiment in FIG. 2, the reflector 104 is mechanically fastened to the mount or support 116 by a single screw 124 (e.g., a single pan head screw, other mechanical fastener etc.). In addition, the mount 116 includes a detent or downwardly protruding portion 128 (e.g., protrusion, nub, dimple, etc.) configured for insertion or engagement within an opening or hole in the reflector 104. The positioning of the detent 128 within the hole of the reflector 104 prevents or at least inhibits rotation of the reflector 104 relative to the mount 116 or the screw 124.

A wide range of materials may be used for the reflector 104, including metals, metal alloys, etc. In an exemplary embodiment, the reflector 104 comprises an electrically-conductive material 114 (FIG. 2) (e.g., copper, etc.) on a dielectric substrate 134 (e.g., PCB material, etc.) (FIG. 1).

In the exemplary embodiment shown in FIGS. 1 through 3, the reflector 104 comprises a circular or round plate or disk that is relatively flat or thin. The reflector 104 is configured (e.g., sized, shaped, etc.) such that the reflector's electrically-conductive portion 114 has a footprint or surface area larger than the footprint or surface area of the antenna structure or radiating element 132 of the patch antenna 112. Stated differently, the reflector's electrically-conductive portion 114 has a footprint or surface area larger than the footprint or surface area of the driven, fed, or excited element 132 of the patch antenna 112. In some exemplary embodiments, the reflector 104 has an overall footprint or surface area larger than the footprint or surface area of the substrate 136 (e.g., ceramic or other dielectric, etc.) of the patch antenna 112. Alternative embodiments may include a differently configured reflector or parasitic element (e.g., non-circular, non-metal, larger, smaller, etc.). For example, another exemplary embodiment may include a reflector (e.g., an electrically-conductive parasitic element, director, etc.) that has an electrically-conductive portion with a footprint or surface area smaller than the antenna structure or radiating element 132 of the patch antenna 112.

As shown in FIG. 3, the antenna assembly 100 includes the first patch satellite antenna 112, a second patch satellite antenna 140, a first or primary cellular antenna 144, and a second or secondary cellular antenna 148. The antenna assembly 100 may be operable as a multiband multiple input multiple output (MIMO) vehicular antenna assembly.

As noted above, the first satellite patch antenna 112 is configured to be operable for receiving SDARS signals (e.g., SiriusXM, etc.). The second patch antenna 140 is configured to be operable for receiving Global Navigation Satellite System (GNSS) signals or frequencies (e.g., Global Positioning System (GPS), BeiDou Navigation Satellite System (BDS), the Russian Global Navigation Satellite System (GLONASS), other satellite navigation system frequencies, etc.).

The first and second patch antennas 112, 140 are horizontally spaced apart from each other. In other exemplary embodiments, the first and second patch antennas 112, 140 may be in a stacked arrangement with one of the patch antennas stacked on top of the other patch antenna.

In exemplary embodiments, the SDARS signals may be fed via a coaxial cable to a SDARS radio, which, in turn, may be located in an Instrument Panel (IP) that is independent from a Telematics Control Unit (TCU) box. By way of background, the frequency range or bandwidth of GPS(L1) is 1575.42 MHz±1.023 MHz, the frequency range or bandwidth of BDS(B1) is 1561.098 MHz±2.046 MHz, the frequency range or bandwidth of GLONASS(L1) is 1602.5625 MHz±4 MHz, and the frequency range or bandwidth of SDARS is 2320 MHz to 2345 MHz. Also, for example, the second patch antenna 140 may be operable from about 1558 MHz to about 1608 MHz.

In this illustrated embodiment, the first cellular antenna 144 is a monopole antenna (e.g., stamped metal wide band monopole antenna mast, etc.) configured to be operable for both receiving and transmitting communication signals within one or more cellular frequency bands (e.g., Long Term Evolution (LTE), etc.). By way of example only, the first cellular antenna 144 may be a cellular antenna mast that is identical to or substantially identical to an antenna mast (e.g., stamped metal monopole antenna mast, etc.) disclosed in U.S. Pat. No. 7,492,318, the entire contents of which is incorporated herein by reference. Alternative embodiments may include a first cellular antenna that is configured differently than shown in FIG. 1 of this application or disclosed in U.S. Pat. No. 7,492,318.

The first cellular antenna 144 may be connected to and supported by a printed circuit board (PCB) 152. For example, the first cellular antenna 144 has one or more bent or formed tabs at the bottom, which may provide areas for soldering the first cellular antenna 144 to the PCB 152. The first cellular antenna 144 may also include a downwardly extending projection that may be at least partially received within a corresponding opening in the PCB 152, for example, to make electrical connection to a PCB component on the opposite side of the PCB 152. Alternatively, other embodiments may include other means for soldering or connecting the first cellular antenna 144 to the PCB 152.

The PCB 152 is supported by a chassis or body 156. In this example embodiment, the PCB 152 is mechanically fastened via fasteners 160 (e.g., screws, etc.) to the chassis 156.

The second or secondary cellular antenna 148 is configured to be operable for receiving (but not transmitting) communication signals within one or more cellular frequency bands (e.g., LTE, etc.). In alternative embodiments, the second cellular antenna 148 may be configured to transmit in a different channel (Dual Channel feature) or transmit at the same channel but at a different time slot (Tx Diversity).

The second cellular antenna 148 may be supported and held in position by a support, which may comprise plastic or other dielectric material. The second cellular antenna 148 may include downwardly extending portions, legs, or shorts configured to be slotted or extended into holes in the PCB 152 for connection (e.g., solder, etc.) to a feed network. The second cellular antenna 148 may comprise stamped and bent sheet metal. Alternative embodiments may include a second cellular antenna that is configured differently (e.g., inverted L antenna (ILA), planar inverted F antenna (PIFA), an antenna made of different materials and/or via different manufacturing processes, etc.). The second cellular antenna 148 may be connected to and supported by the printed circuit board (PCB) 152 by, for example, soldering, etc.

Each patch antenna 112, 140 may include a substrate 136, 142 (FIG. 3) made of a dielectric material, for example, a ceramic. An electrically-conductive material may be disposed on the upper surface of the substrate to form the antenna structure 132, 146 (e.g., λ/2-antenna structure, etc.) of the patch antennas 112, 140, respectively. Connectors 150, 154 may connect the respective antenna structures 132, 146 of the patch antennas 112, 140 to the PCB 152. A metallization may cover the entire area (or substantially the entire area) of the lower surface of the substrate 136, 142 of each patch antenna 112, 140. For example, a metallization may be provided on the lower surface of the substrate. Additionally, or alternatively, a metallization may be a separate or discrete metallization element abutting against the lower surface of the substrate. Each connector may run through the corresponding substrate to preferably provide a galvanic connection between the antenna structure on the top of the substrate and the metallization on the bottom of the substrate, setting these at equal potential.

The radome or cover 108 is provided to help protect the various components of the antenna assembly 100 enclosed within an interior spaced defined by the radome 108 and the chassis 156. For example, the radome 108 may substantially seal the components of the antenna assembly 100 within the radome 108 thereby protecting the components against ingress of contaminants (e.g., dust, moisture, etc.) into an interior enclosure of the radome 108. In addition, the radome 108 may have an aesthetically pleasing, aerodynamic shark-fin configuration. The radome 108 (and any other radome or cover disclosed herein) may be opaque, translucent, transparent, and/or be provided in a variety of colors. In other example embodiments, antenna assemblies may include covers having configurations different than illustrated herein. The radome 108 (and any other cover disclosed herein) may be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, thermoplastic materials (e.g., GE Plastics Geloy™ XP4034 Resin, etc.), synthetic resin materials, etc. within the scope of the present disclosure.

The radome 108 is configured to fit over the first and second patch antennas 112, 140 and the first and second cellular antennas 144, 148 such that the antennas 112, 140, 144, 148 are colocated under the radome 108. The radome 108 is configured to be secured to the chassis 156. In this illustrated embodiment, the radome 108 is secured to the chassis 156 by mechanical fasteners 164 (e.g., screws, etc.). Alternatively, the radome 108 may secure to the chassis 156 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc.

The chassis or base 156 may be configured to couple to a roof of a car for installing the antenna assembly 100 to the car. Alternatively, the radome 108 may connect directly to the roof of a car within the scope of the present disclosure.

Figure 4:
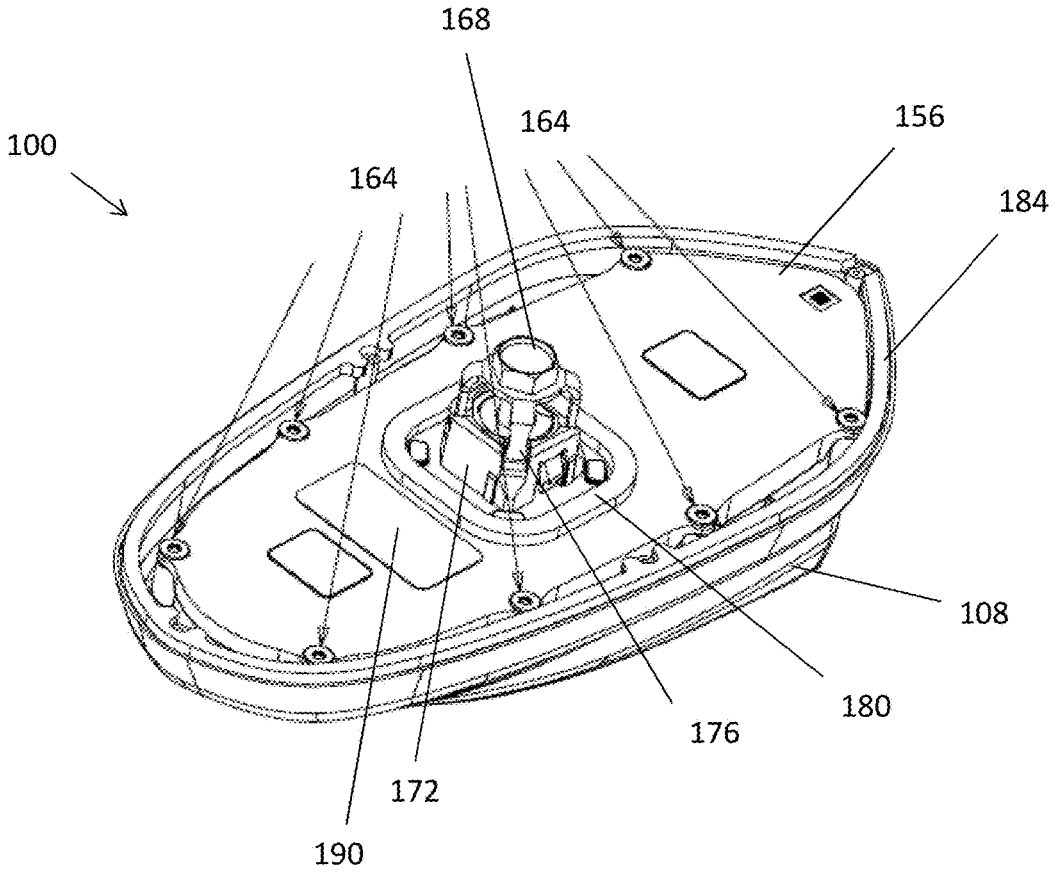
FIG. 4 is a lower perspective view of the vehicular antenna assembly shown in FIG. 3 after the components have been assembled.

As shown in FIGS. 3 and 4, the antenna assembly 100 includes a fastener member 168 (e.g., threaded mounting bolt having a hexagonal head, etc.), a first retention component 172 (e.g., an insulator clip, etc.), and a second retention component 176 (e.g., retaining clip, etc.). The fastener member 168 and retention members 172, 176 may be used to mount the antenna assembly 100 to an automobile roof, hood, trunk (e.g., with an unobstructed view overhead or toward the zenith, etc.) where the mounting surface of the automobile acts as a ground plane for the antenna assembly.

The fastener member 168 and retaining components 172, 176 allow the antenna assembly 100 to be installed and fixedly mounted to a vehicle body wall 177 (FIG. 5). The fastener member 168 and retaining components 172, 176 may first be inserted into a mounting hole in the vehicle body wall from an external side of the vehicle such that the chassis 156 is disposed on the external side of the vehicle body wall and the fastener member 168 is accessible from inside the vehicle. In this stage of the installation process, the antenna assembly 100 may thus be held in place relative to the vehicle body wall in a first installed position.

The second retaining component 176 includes legs, and the first retaining component 172 includes tapered faces. The first and second retaining components 172, 176 also include aligned openings through which passes the fastener member 168 to be threadedly connected to a threaded opening in the chassis 156.

The legs of the retaining component 176 are configured to make contact with the corresponding tapered faces of the other retaining component 172. When the second retaining component 176 is compressively moved generally towards the mounting hole by driving the fastener member 168 in a direction generally towards the base 156, the legs may deform and expand generally outwardly relative to the mounting hole against the interior compartment side of the vehicle body wall, thereby securing the antenna assembly 100 to the vehicle body wall in a second, operational installed position.

In other embodiments, an antenna assembly may include a fastener member, first retaining component, and second retaining component as disclosed in U.S. Pat. No. 7,492,319, the entire contents of which is incorporated herein by reference. The antenna assembly could be mounted differently within the scope of the present disclosure. For example, the antenna assembly could be installed to a truck, a bus, a recreational vehicle, a boat, a vehicle without a motor, etc. within the scope of the present disclosure.

The chassis 156 (and any other chassis disclosed herein) may be formed from a wide range of materials. For example, the chassis 156 may be injection molded from polymer. Alternatively, the chassis 156 may be formed from steel, zinc, or other material (including composites) by a suitable forming process, for example, a die cast process, etc. within the scope of the present disclosure. As a further example, the antenna assembly 100 may include a composite antenna chassis or base that is identical to or substantially identical to a composite chassis or base disclosed in U.S. Patent Application Publication 2008/0100521, the entire contents of which is incorporated herein by reference.

The antenna assembly 100 includes a sealing member 180 (e.g., urethane phone gasket, an O-ring, a resiliently compressible elastomeric or foam gasket, a PORON microcellular urethane foam gasket, etc.) that will be positioned between the chassis 156 and the roof of a car (or other mounting surface). The sealing member 180 may substantially seal the mounting hole in the roof. A sealing member 184 (e.g., foam dust shield, etc.) may also be positioned between the chassis 156 and the roof of a car (or other mounting surface) to substantially seal the chassis 156 against the roof. One or more sealing members 188 (e.g., an O-ring, a resiliently compressible elastomeric or foam gasket, caulk, adhesives, other suitable packing or sealing members, etc.) may also, or alternatively, be provided between the radome 108 and the chassis 156 for substantially sealing the radome 108 against the chassis 156. The sealing member 188 may be at least partially seated within a groove defined along or by the chassis 156. In some embodiments, sealing may be achieved by one or more integral sealing features rather than with a separate sealing mechanism. A label 190 may be adhesively attached along a bottom surface of the chassis 156.

The first and second cellular antennas 144, 148 may be positioned relatively close to each other. The antenna assembly 100 is preferably configured such there is sufficient de-correlation (e.g., a correlation less than about 25 percent, etc.), sufficiently low coupling, and sufficient isolation (e.g., at least about 15 decibels, etc.) between the cellular antennas 144, 148. The antenna assembly 100 may be operable over multiple frequency bands, including LTE and others.

The antenna assembly 100 further includes foam pads 191, 192 as shown in FIG. 3. The foam pads 191, 192 may be respectively positioned about portions of the first and second cellular antennas 144, 148, for example, to help hold the antennas in place and/or inhibit vibrations during travel of the vehicle to which the antenna assembly 100 in mounted.

FIG. 5 illustrates exemplary coaxial cable assemblies 193 and 194 for connecting the vehicular antenna assembly 100 to one or more electronic devices (e.g., a radio receiver, a touchscreen display, navigation device, cellular phone, etc.) inside the passenger compartment of a vehicle, such that the vehicular antenna assembly is operable for transmitting and/or receiving signals to/from the electronic device(s) inside the vehicle.

FIG. 6 illustrates an exemplary manner by which the coaxial cables 195, 196, and 197 may be connected to components (e.g., low noise amplifier (LNA), etc.) along a bottom side of a printed circuit board of the vehicular antenna assembly shown in FIG. 3. The coaxial cable 195 may be used for transmitting satellite signals (e.g., SDARS signals, etc.) received by the first patch antenna 112. The coaxial cable 196 may be used for transmitting signals to/from the first or primary cellular antenna 144. The coaxial cable 197 may be used for transmitting signals received by the second or secondary cellular antenna 148 and signals received by the GPS patch antenna 142.

The antenna assembly 100 may have a height of about 66 millimeters and a footprint having a length of about 162 millimeters and a width of about 83 millimeters. Alternatively, the antenna assembly may have a different size in other exemplary embodiments.

Exemplary embodiments are disclosed of vehicular antenna assemblies. In an exemplary embodiment, the vehicular antenna assembly generally includes a chassis, a radome, a satellite antenna, and a reflector. The radome includes an inner surface and a mount along the inner surface. The satellite antenna is configured to be operable for receiving satellite signals. The satellite antenna is within an interior space cooperatively defined by or between the chassis and the inner surface of the radome. The reflector is mounted to the mount of the radome and configured to be operable for reflecting satellite signals generally towards the satellite antenna.

The reflector may be mechanically fastened to the mount of the radome with a single screw.

The reflector may include a fastener hole. The mount may include a fastener hole aligned with the fastener hole of the reflector. The reflector may be mounted to the mount of the radome with a single mechanical fastener inserted through the aligned fastener holes of the reflector and the mount.

The reflector may include an opening. The mount may include a detent engaged within the opening of the reflector. Engagement of the detent within the opening may inhibit rotation of the reflector relative to the mount.

The reflector may comprise an electrically-conductive circular plate.

The mount may be integral to the radome such that the radome and the mount have a monolithic, single piece construction.

The mount may comprise a mounting member extending downwardly from the inner surface of the radome towards the satellite antenna. The reflector may be positioned directly above and spaced apart from the satellite antenna.

The satellite antenna may comprise a patch antenna including a dielectric substrate and an antenna structure on the substrate. The reflector may include an electrically-conductive surface that is substantially planar and substantially parallel with the antenna structure of the patch antenna. The electrically-conductive surface may be operable for reflecting satellite signals generally towards the antenna structure of the patch antenna. The electrically-conductive surface of the reflector has a surface area larger or smaller than a surface area of the antenna structure of the patch antenna.

The satellite antenna may be a first satellite antenna. The vehicular antenna assembly may further comprise a second satellite antenna, a first cellular antenna, and a second cellular antenna. The second satellite antenna may be configured to be operable for receiving satellite signals different than the satellite signals received by the first satellite antenna. The first cellular antenna may be configured to be operable for receiving and transmitting communication signals within one or more cellular frequency bands. The second cellular antenna may be configured to be operable for receiving (but not transmitting) communication signals within one or more cellular frequency bands. The first and second satellite antennas and the first and second cellular antennas may be within the interior space cooperatively defined by or between the chassis and the inner surface of the radome.

The radome may have a shark-fin configuration. The vehicular antenna assembly may comprise a printed circuit board supported by the chassis and within the interior space cooperatively defined by or between the chassis and the inner surface of the radome. The first satellite antenna may comprise a first patch antenna configured to be operable for receiving satellite digital audio radio services (SDARS) signals and/or with frequencies from 2320 MHz to 2345 MHz. The second satellite antenna may comprise a second patch antenna configured to be operable for receiving Global Navigation Satellite System (GNSS) signals or frequencies and/or with frequencies from 1558 MHz to 1608 MHz. The first cellular antenna may be configured to be operable as a primary cellular antenna for both receiving and transmitting communication signals within one or more cellular frequency bands including Long Term Evolution (LTE) frequencies. The second cellular antenna may be configured to be operable as a secondary cellular antenna for receiving (but not transmitting) communication signals within one or more cellular frequency bands including Long Term Evolution (LTE) frequencies. The vehicular antenna assembly may be configured to be installed and fixedly mounted to a body wall of a vehicle after being inserted into a mounting hole in the body wall from an external side of the vehicle and nipped from an interior compartment side of the vehicle.

Exemplary embodiments are also disclosed of a radome assembly for a vehicular antenna assembly including a satellite antenna configured to be operable for receiving satellite signals. In an exemplary embodiment, a radome assembly generally includes a radome and reflector. The radome is configured to be positioned over a satellite antenna of a vehicular antenna assembly. The radome includes an inner surface and a mount along the inner surface. The reflector is mounted to the mount of the radome. The mount and the reflector are configured such that the reflector is operable for reflecting satellite signals generally towards the satellite antenna when the radome is positioned over the satellite antenna.

The reflector may be mechanically fastened to the mount of the radome with a single screw.

The reflector may include a fastener hole. The mount may include a fastener hole aligned with the fastener hole of the reflector. The reflector may be mounted to the mount of the radome with a single mechanical fastener inserted through the aligned fastener holes of the reflector and the mount.

The reflector may include an opening. The mount may include a detent engaged within the opening of the reflector. Engagement of the detent within the opening inhibits rotation of the reflector relative to the mount.

The mount may be integral to the radome such that the radome and the mount have a monolithic, single piece construction.

The mount may comprise a mounting member extending downwardly from the inner surface of the radome such that the reflector is positioned directly above and spaced apart from the satellite antenna when the radome is positioned over the satellite antenna of the vehicular antenna assembly.

A vehicular antenna assembly may include the radome assembly, a satellite antenna, and a chassis. The satellite antenna may be within an interior space cooperatively defined by or between the chassis and the inner surface of the radome. The reflector may be positioned relative to the satellite antenna for reflecting the satellite signal generally towards the satellite antenna.

The satellite antenna may comprise a patch antenna including a dielectric substrate and an antenna structure on the substrate. The reflector may include an electrically-conductive surface that is substantially planar and substantially parallel with the antenna structure of the patch antenna. The electrically-conductive surface may be operable for reflecting satellite signals generally towards the antenna structure of the patch antenna. The electrically-conductive surface of the reflector may have a surface area larger or smaller than a surface area of the antenna structure of the patch antenna.

The satellite antenna may comprise a first patch antenna configured to be operable for receiving satellite digital audio radio services (SDARS) signals. The reflector may be positioned relative to the first patch antenna for refocusing, directing, and/or reflecting the SDARS signals to the first patch antenna. The radome may have a shark-fin configuration. The vehicular antenna assembly may further comprise a second patch antenna configured to be operable for receiving satellite navigation signals, a first cellular antenna configured to be operable for receiving and transmitting communication signals within one or more cellular frequency bands, and a second cellular antenna configured to be operable for receiving (but not transmitting) communication signals within one or more cellular frequency bands. The first and second patch antennas and the first and second cellular antennas may be within the interior space cooperatively defined by or between the chassis and the inner surface of the radome. The vehicular antenna assembly may be configured to be installed and fixedly mounted to a body wall of a vehicle after being inserted into a mounting hole in the body wall from an external side of the vehicle and nipped from an interior compartment side of the vehicle.

Exemplary embodiments are also disclosed of methods relating to a vehicular antenna assembly including a satellite antenna configured to be operable for receiving satellite signals. In an exemplary embodiment, the method generally includes mounting a reflector to a mount along an inner surface of a radome that is positionable over the satellite antenna, whereby the reflector is operable for reflecting satellite signals generally towards the satellite antenna when the radome is positioned over the satellite antenna; or positioning a radome of the vehicular antenna assembly relative to the satellite antenna such that a reflector mounted internally to the radome is positioned for reflecting satellite signals generally towards the satellite antenna.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicular antenna assembly comprising:
a chassis;
a radome including an inner surface and a mount along the inner surface;
a satellite antenna configured to be operable for receiving satellite signals, the satellite antenna is within an interior space cooperatively defined by or between the chassis and the inner surface of the radome; and
a reflector mounted to the mount of the radome and configured to be operable for reflecting satellite signals generally towards the satellite antenna;
wherein:
the satellite antenna comprises a patch antenna including a dielectric substrate and an antenna structure on the dielectric substrate;
the reflector includes an electrically-conductive surface that is substantially planar and substantially parallel with the antenna structure of the patch antenna, whereby the electrically-conductive surface is operable for reflecting satellite signals generally towards the antenna structure of the patch antenna; and
the electrically-conductive surface of the reflector has a surface area larger or smaller than a surface area of the antenna structure of the patch antenna.

2. The vehicular antenna assembly of claim 1, wherein the reflector is mechanically fastened to the mount of the radome with a single screw.

3. The vehicular antenna assembly of claim 1, wherein:
the reflector includes a fastener hole;
the mount includes a fastener hole aligned with the fastener hole of the reflector; and
the reflector is mounted to the mount of the radome with a single mechanical fastener inserted through the aligned fastener holes of the reflector and the mount.

4. The vehicular antenna assembly of claim 1, wherein the reflector comprises an electrically-conductive circular plate.

5. The vehicular antenna assembly of claim 1, wherein the mount is integral to the radome such that the radome and the mount have a monolithic, single piece construction.

6. The vehicular antenna assembly of claim 1, wherein:
the mount comprises a mounting member extending downwardly from the inner surface of the radome towards the satellite antenna; and
the reflector is positioned directly above and spaced apart from the satellite antenna.

7. A vehicular antenna assembly comprising:
a chassis;
a radome including an inner surface and a mount along the inner surface;
a satellite antenna configured to be operable for receiving satellite signals, the satellite antenna is within an interior space cooperatively defined by or between the chassis and the inner surface of the radome; and
a reflector mounted to the mount of the radome and configured to be operable for reflecting satellite signals generally towards the satellite antenna;
wherein:
the reflector includes an opening; and
the mount includes a detent engaged within the opening of the reflector;
whereby engagement of the detent within the opening inhibits rotation of the reflector relative to the mount.

8. The vehicular antenna assembly of claim 7, wherein:
the satellite antenna comprises a patch antenna including a dielectric substrate and an antenna structure on the dielectric substrate;
the reflector includes an electrically-conductive surface that is substantially planar and substantially parallel with the antenna structure of the patch antenna, whereby the electrically-conductive surface is operable for reflecting satellite signals generally towards the antenna structure of the patch antenna; and
the electrically-conductive surface of the reflector has a surface area larger or smaller than a surface area of the antenna structure of the patch antenna.

9. A vehicular antenna assembly comprising:
a chassis;
a radome including an inner surface and a mount along the inner surface;
a satellite antenna configured to be operable for receiving satellite signals, the satellite antenna is within an interior space cooperatively defined by or between the chassis and the inner surface of the radome; and
a reflector mounted to the mount of the radome and configured to be operable for reflecting satellite signals generally towards the satellite antenna;
wherein:
the satellite antenna is a first satellite antenna;
the vehicular antenna assembly comprises:
a second satellite antenna configured to be operable for receiving satellite signals different than the satellite signals received by the first satellite antenna;
a first cellular antenna configured to be operable for receiving and transmitting communication signals within one or more cellular frequency bands; and
a second cellular antenna configured to be operable for receiving (but not transmitting) communication signals within one or more cellular frequency bands; and
the first and second satellite antennas and the first and second cellular antennas are within the interior space cooperatively defined by or between the chassis and the inner surface of the radome.

10. The vehicular antenna assembly of claim 9, wherein:
the radome has a shark-fin configuration;
the vehicular antenna assembly further comprises a printed circuit board supported by the chassis and within the interior space cooperatively defined by or between the chassis and the inner surface of the radome;
the first satellite antenna comprises a first patch antenna configured to be operable for receiving satellite digital audio radio services (SDARS) signals and/or with frequencies from 2320 MHz to 2345 MHz;
the second satellite antenna comprises a second patch antenna configured to be operable for receiving Global Navigation Satellite System (GNSS) signals or frequencies and/or with frequencies from 1558 MHz to 1608 MHz;

the first cellular antenna is configured to be operable as a primary cellular antenna for both receiving and transmitting communication signals within one or more cellular frequency bands including Long Term Evolution (LTE) frequencies;

the second cellular antenna is configured to be operable as a secondary cellular antenna for receiving (but not transmitting) communication signals within one or more cellular frequency bands including Long Term Evolution (LTE) frequencies; and the vehicular antenna assembly is configured to be installed and fixedly mounted to a body wall of a vehicle after being inserted into a mounting hole in the body wall from an external side of the vehicle and nipped from an interior compartment side of the vehicle.

11. A radome assembly for a vehicular antenna assembly including a satellite antenna configured to be operable for receiving satellite signals, the radome assembly comprising:

a radome configured to be positioned over the satellite antenna of the vehicular antenna assembly, the radome including an inner surface and a mount along the inner surface; and a reflector mounted to the mount of the radome;

whereby the mount and the reflector are configured such that the reflector is operable for reflecting satellite signals generally towards the satellite antenna when the radome is positioned over the satellite antenna;

wherein:

the reflector includes an opening; and the mount includes a detent engaged within the opening of the reflector;

whereby engagement of the detent within the opening inhibits rotation of the reflector relative to the mount.

12. The radome assembly of claim 11, wherein the reflector is mechanically fastened to the mount of the radome with a single screw.

13. The radome assembly of claim 11, wherein:

the reflector includes a fastener hole;

the mount includes a fastener hole aligned with the fastener hole of the reflector; and the reflector is mounted to the mount of the radome with a single mechanical fastener inserted through the aligned fastener holes of the reflector and the mount.

14. The radome assembly of claim 11, wherein the mount is integral to the radome such that the radome and the mount have a monolithic, single piece construction.

15. The radome assembly of claim 11, wherein the mount comprises a mounting member extending downwardly from the inner surface of the radome such that the reflector is positioned directly above and spaced apart from the satellite antenna when the radome is positioned over the satellite antenna of the vehicular antenna assembly.

16. A vehicular antenna assembly comprising a radome assembly, a satellite antenna configured to be operable for receiving satellite signals, and a chassis, the radome assembly comprising:

a radome configured to be positioned over the satellite antenna, the radome including an inner surface and a mount along the inner surface; and a reflector mounted to the mount of the radome;

whereby the mount and the reflector are configured such that the reflector is operable for reflecting satellite signals generally towards the satellite antenna when the radome is positioned over the satellite antenna;

wherein:

the satellite antenna is within an interior space cooperatively defined by or between the chassis and the inner surface of the radome;

the reflector is positioned relative to the satellite antenna for reflecting the satellite signal generally towards the satellite antenna;

the satellite antenna comprises a patch antenna including a dielectric substrate and an antenna structure on the dielectric substrate;

the reflector includes an electrically-conductive surface that is substantially planar and substantially parallel with the antenna structure of the patch antenna, whereby the electrically-conductive surface is operable for reflecting satellite signals generally towards the antenna structure of the patch antenna; and the electrically-conductive surface of the reflector has a surface area larger or smaller than a surface area of the antenna structure of the patch antenna.

17. A vehicular antenna assembly comprising a radome assembly, a satellite antenna configured to be operable for receiving satellite signals, and a chassis, the radome assembly comprising:

a radome configured to be positioned over the satellite antenna, the radome including an inner surface and a mount along the inner surface; and a reflector mounted to the mount of the radome;

whereby the mount and the reflector are configured such that the reflector is operable for reflecting satellite signals generally towards the satellite antenna when the radome is positioned over the satellite antenna;

wherein:

the satellite antenna is within an interior space cooperatively defined by or between the chassis and the inner surface of the radome;

the reflector is positioned relative to the satellite antenna for reflecting the satellite signal generally towards the satellite antenna;

the satellite antenna comprises a first patch antenna configured to be operable for receiving satellite digital audio radio services (SDARS) signals;

the reflector is positioned relative to the first patch antenna for refocusing, directing, and/or reflecting the SDARS signals to the first patch antenna;

the radome has a shark-fin configuration;

the vehicular antenna assembly further comprises:

a second patch antenna configured to be operable for receiving satellite navigation signals;

a first cellular antenna configured to be operable for receiving and transmitting communication signals within one or more cellular frequency bands; and a second cellular antenna configured to be operable for receiving (but not transmitting) communication signals within one or more cellular frequency bands;

the first and second patch antennas and the first and second cellular antennas are within the interior space cooperatively defined by or between the chassis and the inner surface of the radome; and the vehicular antenna assembly is configured to be installed and fixedly mounted to a body wall of a vehicle after being inserted into a mounting hole in the body wall from an external side of the vehicle and nipped from an interior compartment side of the vehicle.

* * * * *